US009795174B2

(12) United States Patent
Fitch

(10) Patent No.: US 9,795,174 B2
(45) Date of Patent: Oct. 24, 2017

(54) PROTECTIVE PAD SYSTEMS AND METHODS

(71) Applicant: Nathan Lee Fitch, Ft Mitchell, KY (US)

(72) Inventor: Nathan Lee Fitch, Ft Mitchell, KY (US)

( * ) Notice: Subject to any disclaimer, the term of this patent is extended or adjusted under 35 U.S.C. 154(b) by 266 days.

(21) Appl. No.: 14/515,132

(22) Filed: Oct. 15, 2014

(65) Prior Publication Data

US 2015/0101095 A1 Apr. 16, 2015

Related U.S. Application Data

(60) Provisional application No. 61/891,663, filed on Oct. 16, 2013.

(51) Int. Cl.
*A41D 13/00* (2006.01)
*A41D 13/08* (2006.01)

(52) U.S. Cl.
CPC ..... *A41D 13/08* (2013.01)

(58) Field of Classification Search
CPC ..... A41D 13/06; A41D 13/065; A41D 13/08; A41D 13/0005; A41D 13/082; A61F 5/0109; A61F 5/0118; A61F 5/013; A61F 5/50; A63B 69/0057; A63B 69/0071; A63B 69/0059; A63B 2071/125; A63B 71/14; A63B 2244/102
See application file for complete search history.

(56) References Cited

U.S. PATENT DOCUMENTS

| | | | | | |
|---|---|---|---|---|---|
| 2,211,203 | A * | 8/1940 | Goldman | 128/881 |
| 3,712,623 | A * | 1/1973 | Donnald | 473/213 |
| 5,344,152 | A * | 9/1994 | Brannen | 473/214 |
| 5,509,426 | A * | 4/1996 | Sowerby | 128/878 |
| 5,715,535 | A * | 2/1998 | Hamilton et al. | 2/59 |
| 5,865,695 | A * | 2/1999 | Mahala et al. | 473/450 |
| 5,891,079 | A * | 4/1999 | Barnes | 602/61 |
| 8,702,635 | B2 * | 4/2014 | Hegland | 602/22 |
| 8,821,425 | B2 * | 9/2014 | Cox | 602/20 |
| 8,939,853 | B1 * | 1/2015 | Karn et al. | 473/450 |
| 2004/0003454 | A1 * | 1/2004 | Morrow et al. | 2/455 |
| 2009/0253527 | A1 * | 10/2009 | Abraham | 473/214 |

* cited by examiner

*Primary Examiner* — Khaled Annis
(74) *Attorney, Agent, or Firm* — Ulmer & Berne LLP

(57) ABSTRACT

Embodiments described herein include an apparatus to prevent hyper-flexion of a joint that can include a sleeve having a first end and a second end and an upper portion and a lower portion, a first pad, the first pad being associated with the upper portion of the sleeve and configured for positioning within the included angle of a joint, a second pad, the second pad being associated with the upper portion of the sleeve and configured for positioning within the included angle of the joint, where the first pad is spaced apart from the second pad by a distance, and an angle of engagement, where the angle of engagement is a predetermined angle at which the first pad engages the second pad to resist further motion and to prevent hyper-flexion of a joint.

19 Claims, 11 Drawing Sheets

PROTECTIVE PAD SYSTEMS AND METHODS

REFERENCE TO RELATED APPLICATION

The present application claims priority of U.S. provisional application Ser. No. 61/891,663, filed on Oct. 16, 2013, and hereby incorporates the same application herein by reference in its entirety.

TECHNICAL FIELD

Embodiments of the technology relate, in general, to joint protection technology, and in particular to mechanical systems and methods to prevent joint hyper-flexion.

BACKGROUND

It is common for hand and body pads to be worn by a trainer coaching boxers, those practicing the martial arts, and other athletes practicing contact sports. Such pads can include, for example, Muay Thai kick pads and focus mitts. During practice, even with the use of standard padding, a coach will absorb a tremendous amount of shock from the strikes being thrown. Existing pads can be used to block or catch the techniques and generally protect the hand and forearms, but the body still takes on the force received from the blow. In particular, elbow joints and other joints can experience hyper-flexion, particularly from powerful or errant blows. Absorbing the repeated force of kicks, punches, and other blows can lead to hyper-flexion and other injury, but a misplaced strike or blow can cause serious injury to the joints of a trainer or coach.

SUMMARY

In accordance with one embodiment, an apparatus to prevent hyper-flexion of a joint can include a sleeve having a first end and a second end and an upper portion and a lower portion, a first pad, the first pad being associated with the upper portion of the sleeve and configured for positioning within the included angle of a joint, a second pad, the second pad being associated with the upper portion of the sleeve and configured for positioning within the included angle of the joint, where the first pad is spaced apart from the second pad by a distance, and an angle of engagement, where the angle of engagement is a predetermined angle at which the first pad engages the second pad to resist further motion and to prevent hyper-flexion of a joint.

In accordance with one embodiment, an apparatus to prevent hyper-flexion of a joint can include a sleeve having a first end and a second end and an upper portion and a lower portion, a first pad, the first pad being associated with the upper portion of the sleeve, retained within a first covering, and configured for positioning within the included angle of a joint, a second pad, the second pad being associated with the upper portion of the sleeve, retained within a second covering, and configured for positioning within the included angle of the joint, where the first pad is spaced apart from the second pad by a distance, and a means for preventing hyper-flexion of the joint.

In accordance with one embodiment, an apparatus to prevent hyper-flexion of an elbow joint can include a sleeve having a first end and a second end and an upper portion, constructed at least partially from a flexible material, and a lower portion, constructed at least partially from rubberized backing, where the sleeve includes a first annular elastic strip at about the first end and a second annular elastic strip at about the second end, a first pad retained within a first covering, the first pad being associated with the upper portion of the sleeve and configured for positioning within the included angle of the elbow, wherein the first pad is selectively removable from the first covering, a second pad retained within a second covering, the second pad being associated with the upper portion of the sleeve and configured for positioning within the included angle of the elbow, where the second pad is selectively removable from the second covering and where the first pad is spaced apart from the second pad by a distance of from about 0.25 inches to about 1 inch, and an angle of engagement from about 45 degrees to about 125 degrees, where the angle of engagement is a predetermined angle at which the first pad engages the second pad to resist further motion and to prevent hyper-flexion of the elbow.

BRIEF DESCRIPTION OF THE DRAWINGS

The present disclosure will be more readily understood from a detailed description of some example embodiments taken in conjunction with the following figures.

DETAILED DESCRIPTION

Figure 1A:
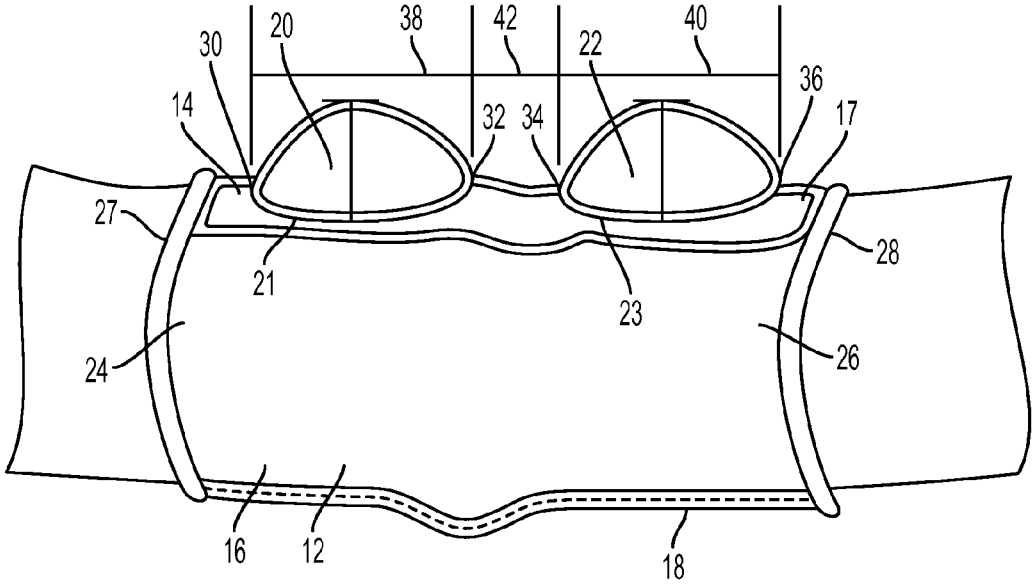
FIG. 1A depicts a right side view of a pad system, shown in a relaxed position, which can minimize the risk of hyper-flexion according to one embodiment.
Figure 1B:
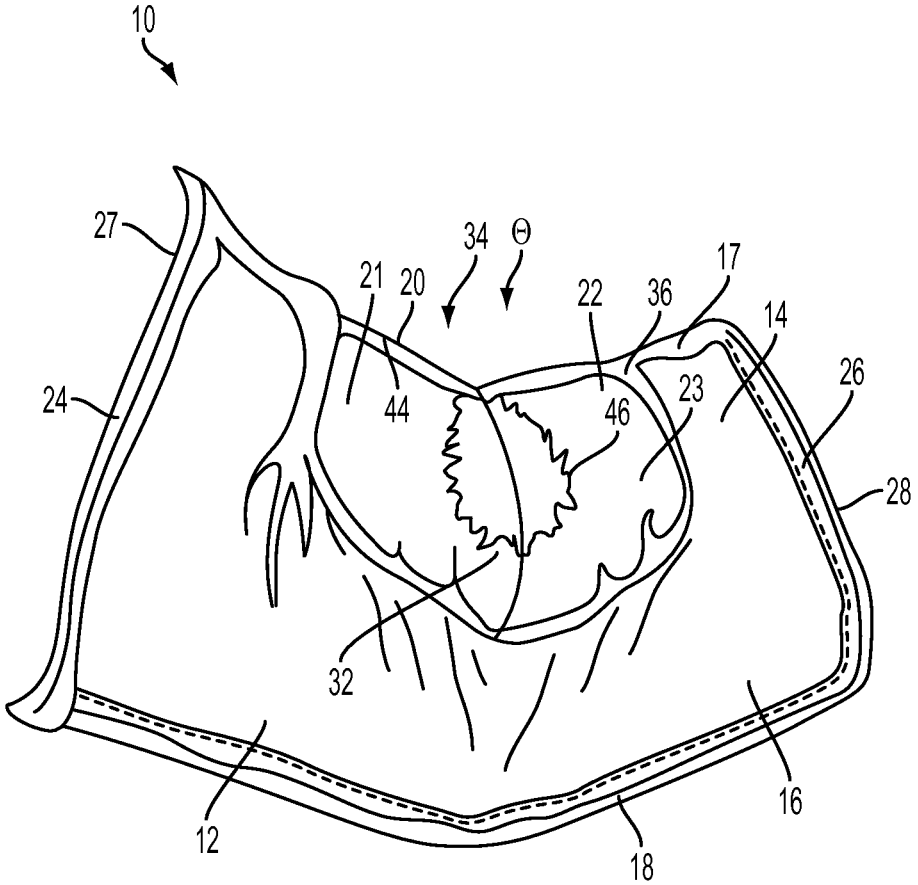
FIG. 1B depicts a perspective view of the pad system of FIG. 1A shown in a flexed position.
Figure 1C:
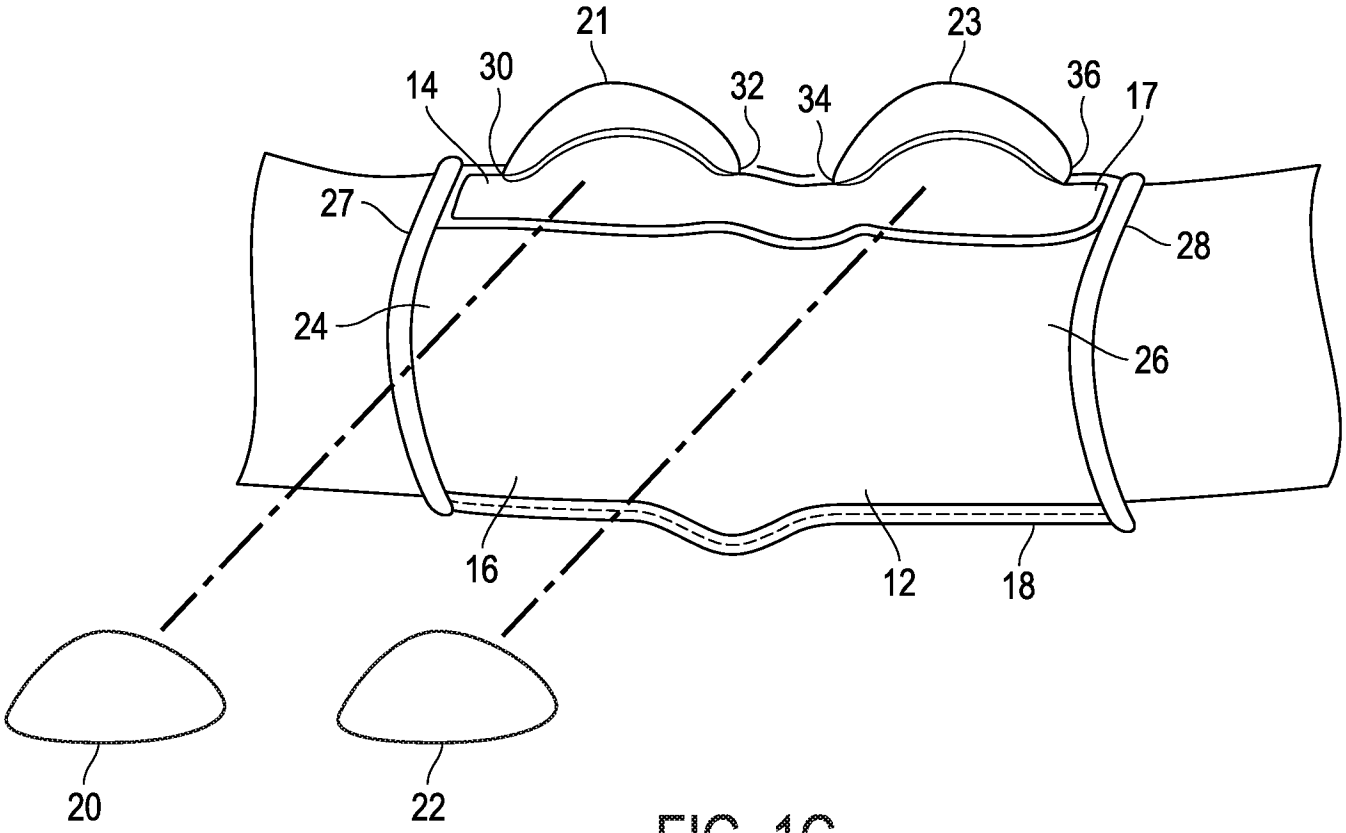
FIG. 1C depicts a perspective view of the pad system of FIG. 1A shown with a first pad removed from a first covering and a second pad removed from a second covering.
Figure 1D:
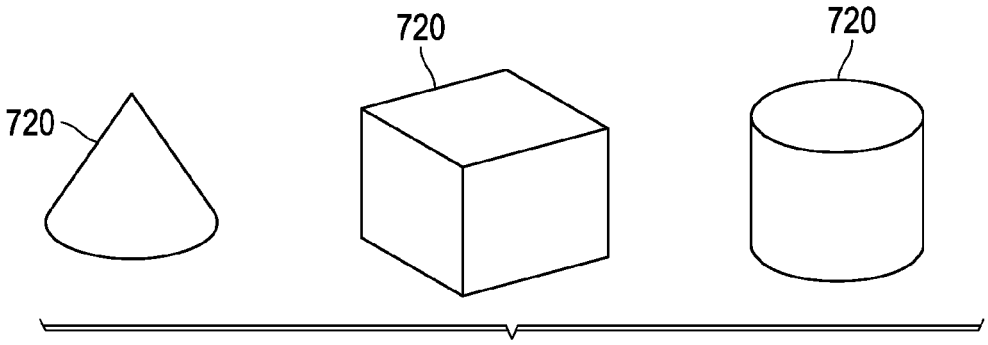
FIG. 1D depicts a perspective view of a plurality of pad shapes that can be associated with the pad system shown in FIG. 1A.
Figure 1E:
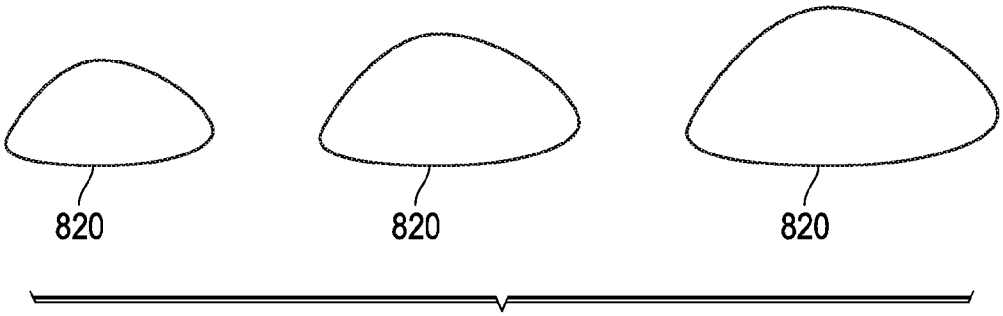
FIG. 1E depicts a perspective view of a plurality of pad sizes that can be associated with the pad system shown in FIG. 1A.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for preventing the hyper-flexion of joints. In one example embodiment, a sleeve worn by a trainer can include a pad system positioned within the included angle of the elbow to prevent hyper-flexion of the elbow during martial arts or boxing practice. In some embodiments, the pad system can be configured to resist flexion of the lower arm relative to the upper arm beyond a threshold level. In some embodiments, the system to prevent hyper-flexion can include a sleeve having a hinge configured to resist relative movement beyond a pre-determined threshold. Embodiments herein can be associated with any joint or physiological structure that can be damaged or otherwise harmed by extending beyond a safe or natural range.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can prevent injury for those that are training athletes practicing boxing, martial arts, or other contact sports. For example, a trainer working with a Muay Thai fighter can wear sleeves having a pad system in accordance with embodiments described herein such that blows received on focus mitts will not cause the trainer's elbow to flex beyond a safe range. The force of the blows can be transferred to the pad system rather than being absorbed by the coach's joint. Additionally, or alternatively, the pad system can include any suitable number of pads or other mechanism, such as a hinge, to prevent hyper-flexion. Example embodiments can be used by trainers or by athletes where a joint is at risk for hyper-flexion.

Referring now to FIG. 1, a pad system 10 can be worn by a user, such as a trainer, to prevent hyper-flexion of a joint such as the elbow. The pad system 10 can include a sleeve 12 having an upper portion 14 and a lower portion 16. The sleeve 12 can be constructed from neoprene and/or an elastic material and can be sized to fit a user's arm. The sleeve 12 can be pulled onto a user's arm until comfortably and suitably positioned such that the upper portion 14 is positioned substantially within the included angle of the elbow or other joint, and the lower portion 16 is positioned substantially over the elbow or joint. The upper portion 14 of the sleeve 12 can be made of a flexible material 17 such as soft and/or pliable neoprene or other material to facilitate flexibility. The lower portion 16 of the sleeve 12 can include a more supportive material, such as rubberized backing material 18, and can include padding that can prevent injury to the elbow during a fall or from a blow. The sleeve 12 can be any suitable length including a full sleeve, a partial sleeve, or can be incorporate into a full suit or other garment. Although an elastic version is shown, it will be appreciated that a more rigid system can be provided where the sleeve, for example, can be wrapped around the joint and secured with a fastener such as a hook and loop fastener to tighten the sleeve. It will be appreciated that the pad system 10 can be associated or configured for use with any body part such as, for example a knee, ankle, or neck.

The sleeve 12, can have a first end 24 and a second end 26, and can include a first pad 20 that can be retained within a first covering 21 and a second pad 22 that can be retained within a second covering 23. When the sleeve 12 is worn correctly, the first pad 20 and the second pad 22 can be situated on the inside of the elbow or any other suitable joint to prevent hyper-flexion. The first pad 20 and the second pad 22 can be configured such that when the forearm of a user is driven towards the body of the user, such as with a boxing blow received by a focus mitt held in the user's hand, the first pad 20 and the second pad 22 can engage at an angle $\ominus$ to resist relative motion of the forearm relative to the upper arm. The sleeve 12 can be designed to fit snugly on the user's arm, or can include tightening elements, to keep the sleeve 12, the first pad 20, and the second pad 20 in place. The pads can be made from any suitable material, such as foam, EM26 foam, gel pads, or a combination thereof. In one embodiment, the pad material can be pliable, elastic, or partially flexible such that a blow can be absorbed gradually by the pad system 10, which may help prevent injury. In one embodiment, the pad material can be inflatable such that a user can selectively adjust the level of inflation for comfort or range of motion. It will be appreciated that the pads can be filled with air, fluid, gel, or any other material. In one embodiment, the sleeve can be relatively loose fitting when pulled on, where one or more pads can be inflated to fit the sleeve snugly to the user's limb.

The sleeve 12 can be constructed in any suitable manner and can include any suitable type and/or combination of fabrics or materials. The rubber backing 18 and flexible material 17 can be integral with, can be stitched onto, or can otherwise be associated with the sleeve 12. The first end 24 and second end 26 of the sleeve 12 can include an annular elastic strip 27, 28 that can improve the durability of the sleeve 12 and aid the user in putting on and taking off the sleeve 12. Materials such as waterproof materials, water-resistant materials, padded materials, and the like are contemplated.

The first pad 20 and the second pad 22 can have any suitable dimensions and configuration to help prevent hyper-flexion of a joint. The first pad 20 and the second pad 22 can be spaced apart when the sleeve 12 is in a relaxed position such that a user has a substantially normal range of motion. The first pad 20 can have a first end 30 and a second end 32 defining a length 38. The second pad 22 can have a first end 34 and a second end 36 defining a length 40. The second end 32 of the first pad 20 and the first end 34 of the second pad can be spaced apart by a distance 42, where the distance 42 can be any suitable dimension such that the first pad 20 and the second pad 20 can engage at a desired angle ⊖ of flexion of a user's forearm and upper arm to prevent hyper-flexion of the elbow joint.

The first pad 20 can have any suitable length 38, such as from about 2 inches to about 3 inches, from about 1 inch to about 3 inches, from about 1 inch to about 5 inches, about 2.5 inches, or any other suitable configuration. The second pad 22 can have any suitable length 40, such as from about 2 inches to about 3 inches, from about 1 inch to about 3 inches, from about 1 inch to about 5 inches, about 2.5 inches, or any other suitable configuration. The first pad 20 can have any suitable height, such as from about 0.5 inches to about 2 inches, from about 1 inch to about 3 inches, or 1.5 inches. The second pad 22 can have any suitable height, such as from about 0.5 inches to about 2 inches, from about 1 inch to about 3 inches, or 1.5 inches. The distance 42 can be any suitable dimension including from about 0.25 inches to about 1 inch, from about 0.5 inches to about 0.75 inches, or the second end 32 of the first pad 20 and the first end 34 of the second pad can be substantially adjacent when the sleeve is in a relaxed position. It will be appreciated that the height, length, and distance between the first pad 20 and second pad 22 can be any suitable dimensions such that the first pad 20 and second pad 22 will engage at a desired threshold of flexion at the angle ⊖. The angle ⊖ of engagement between the first pad and the second pad can be at, for example, from about 45 degrees to about 125 degrees, from about 75 degrees to about 90 degrees, from about 90 degrees to about 120 degrees, or at any suitable angle that can help prevent injury and offer suitable range of motion to a user. The first pad 20 and the second pad 22 can have identical dimensions or can have different dimensions. The first pad 20 and the second pad 20 have any suitable shape such as cone-shaped, box shaped, spherical, rounded edges, elliptical, or the like. In an alternate embodiment, the first pad 20 and/or second pad 22 can include a rigid element such that when the pads engage further flexion is stopped abruptly. It will be appreciated that the pads can be rigid members.

Figure 2:
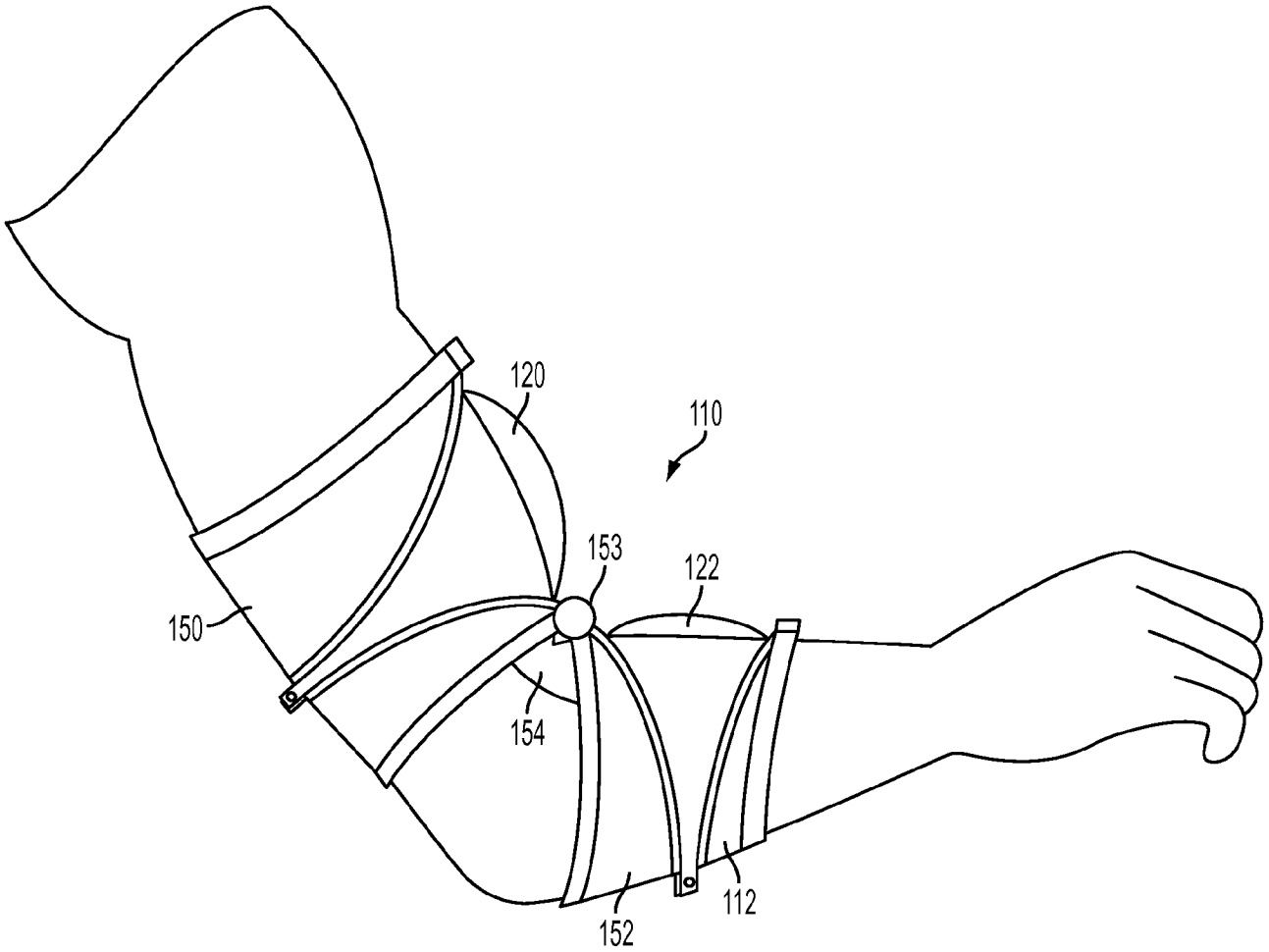
FIG. 2 depicts a right side view of a pad system having a first pad and a second pad according to an alternate embodiment.

Referring now to FIG. 2, an alternate version of a pad system 110 is shown. The pad system 110 can include a sleeve 112 having an upper arm portion 150 and a lower arm portion 152, where the upper arm portion 150 can be coupled with the lower arm portion 152 at a joint 153. The sleeve 112 can be constructed from neoprene or an elastic material and can be sized to fit a user's arm. The sleeve 112 can be pulled onto a user's arm until comfortably and suitably positioned such that the upper portion 150 is positioned substantially above the elbow or other joint, and the lower portion 152 is positioned substantially below the elbow or joint. In the illustrated embodiment, the sleeve can define a cutout 154 at about the position of a user's elbow. It will be appreciated that the pad system 110 can be associated or configured for use with any body part such as, for example a knee, ankle, or neck. The cutout 154 can improve the comfort and range of motion of the sleeve 112.

Figure 3:
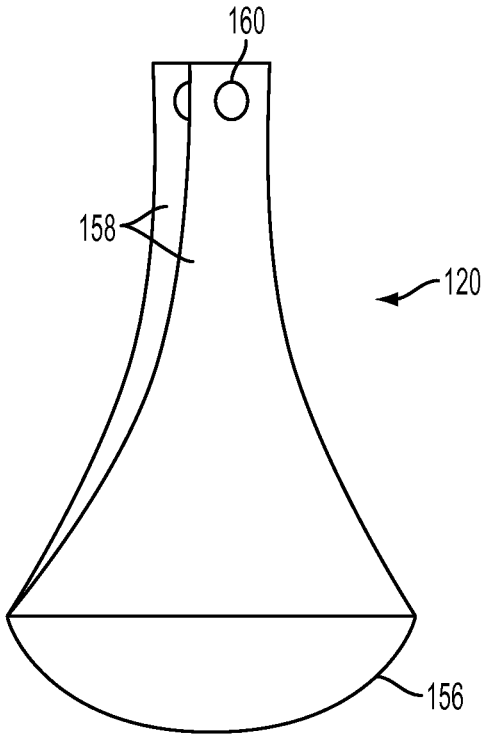
FIG. 3 depicts a right side view of the first pad shown in FIG. 2.

The sleeve 112 can include a first pad 120 and a second pad 122 where, when the sleeve 112 is worn correctly, the first pad 120 and the second pad 122 can be situated on the inside of the elbow or any other suitable joint to prevent hyper-flexion. The first pad 120 and the second pad 122 can be removable such that any suitable pad can be associated with the sleeve 112. Such a configuration may allow the same sleeve 112 to be used in different environments by different users with different padding preferences. For example, a smaller set of pads could be used by someone desiring a wider range of motion and larger pads could be used to provide a highly reduced risk of hyper-flexion injury. The first pad 120 and second pad 122 can be attached in any suitable manner with any suitable fastener. Referring to FIG. 3, the first pad 120 can include a pad portion 156, a pair of straps 158, and a fastener 160 such as a snap that can couple the first pad 120 with the sleeve 112. In one embodiment, the joint 153 can decouple the upper arm portion 150 from the lower arm portion 152 such that different sized arm portions can be used interchangeably. The sleeve 112 could be sold as a kit with a variety of different types and sizes of pads. It will be appreciated that any suitable pads can be attached to the sleeve in any suitable manner such as with hook and loop fasteners, snaps, by placing in a sleeve, with elastic bands, or in any other suitable manner.

Figure 4:
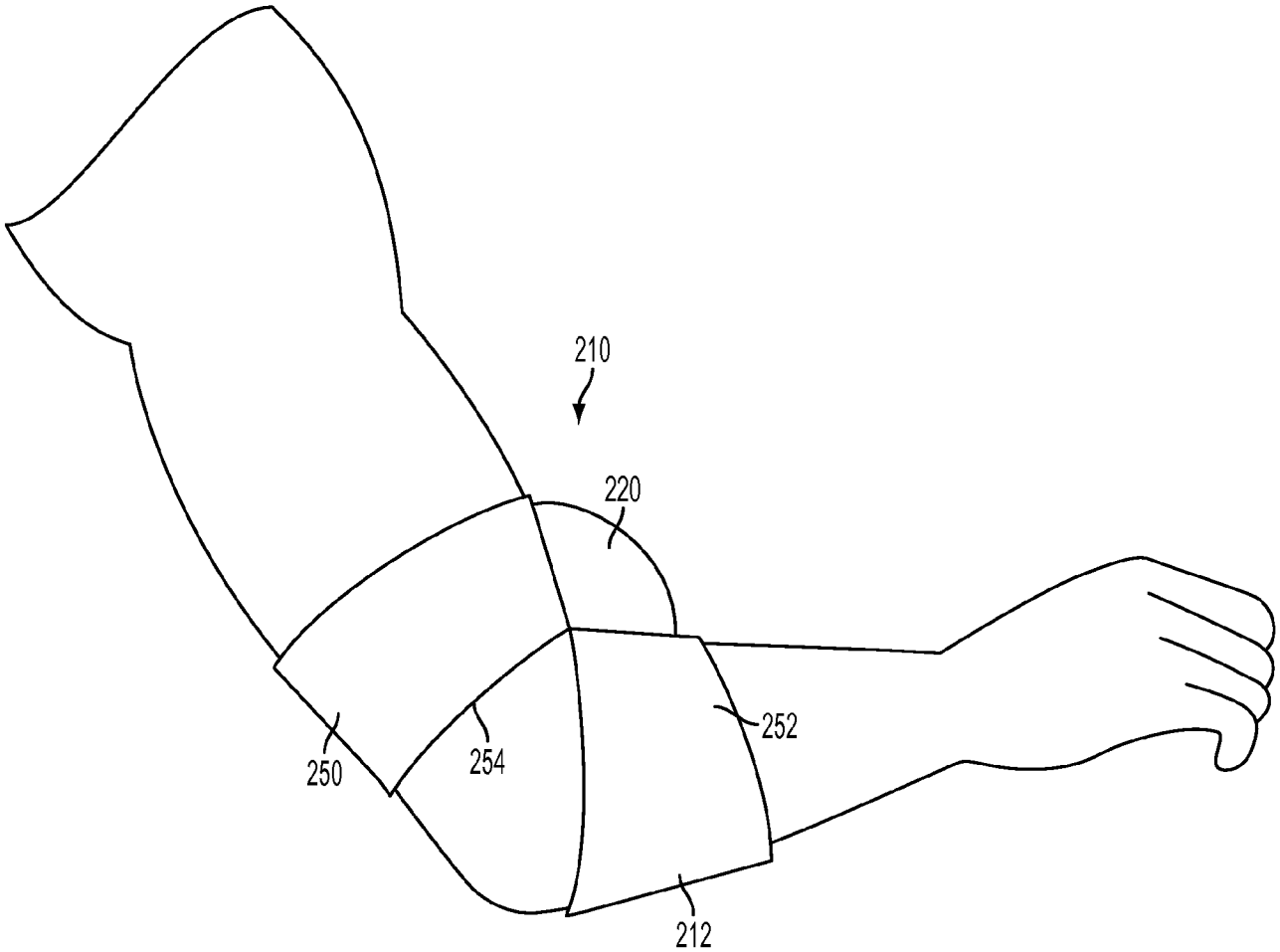
FIG. 4 depicts a right side view of a pad system according to an alternate embodiment.

Referring now to FIG. 4, an alternate version of a pad system 210 is shown. The pad system 210 can include a sleeve 212 having an upper arm portion 250 and a lower arm portion 252. The sleeve 212 can be pulled onto a user's arm until comfortably and suitably positioned such that the upper portion 250 is positioned substantially above the elbow or other joint, and the lower portion 252 is positioned substantially below the elbow or joint. In the illustrated embodiment, the sleeve can define a cutout 254 at about the position of a user's elbow. It will be appreciated that the pad system 210 can be associated or configured for use with any body part such as, for example a knee, ankle, or neck. The sleeve 212 can include a pad 220 where, when the sleeve 212 is worn correctly, the pad 220 can be situated on the inside of the elbow or any other suitable joint to prevent hyper-flexion. As illustrated, a single pad can be sized or otherwise configured to help prevent hyper-flexion of a joint.

Figure 5B:
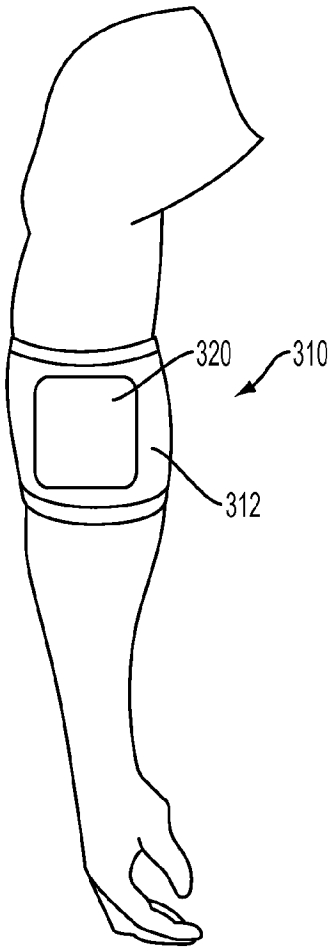
FIG. 5B depicts a top view of the pad system shown in FIG. 5A.
Figure 5A:
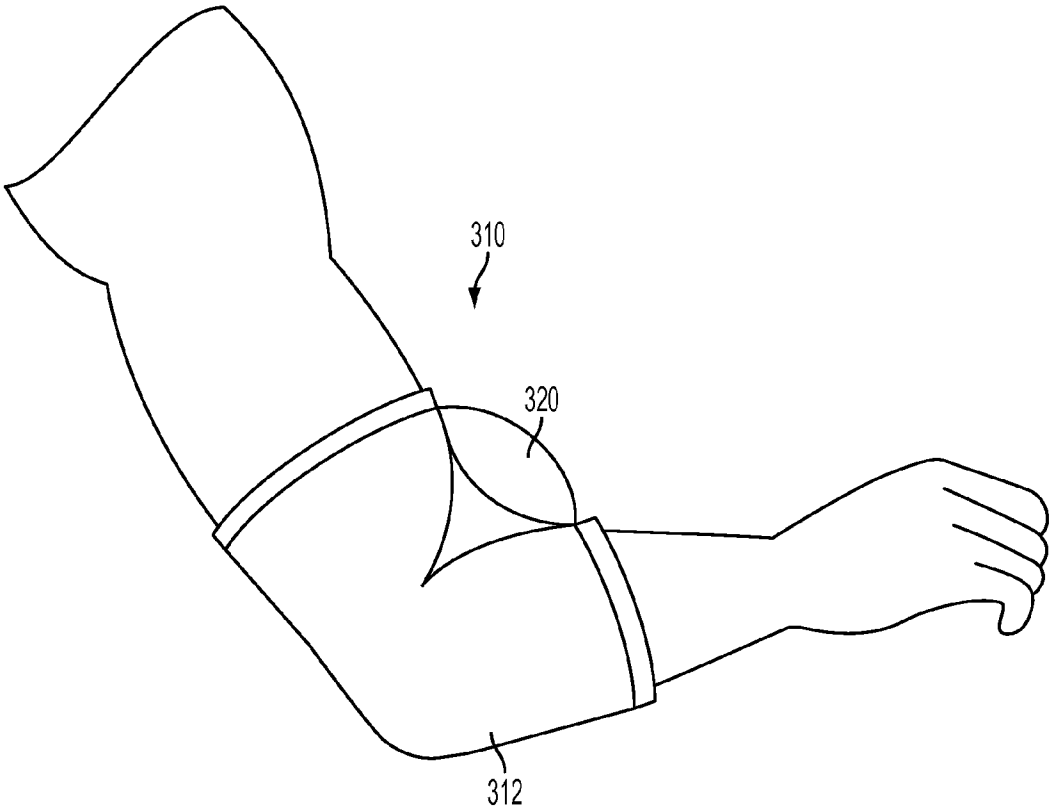
FIG. 5A depicts a right side view of a pad system according to an alternate embodiment.

Referring now to FIG. 5, an alternate version of a pad system 10 is shown. The pad system 310 can include a sleeve 312. The sleeve 312 can be pulled onto a user's arm until comfortably and suitably positioned. It will be appreciated that the pad system 310 can be associated or configured for use with any body part such as, for example a knee, ankle, or neck. The sleeve 312 can include a pad 320 where, when the sleeve 312 is worn correctly, the pad 320 can be situated on the inside of the elbow or any other suitable joint to prevent hyper-flexion.

Figure 6B:
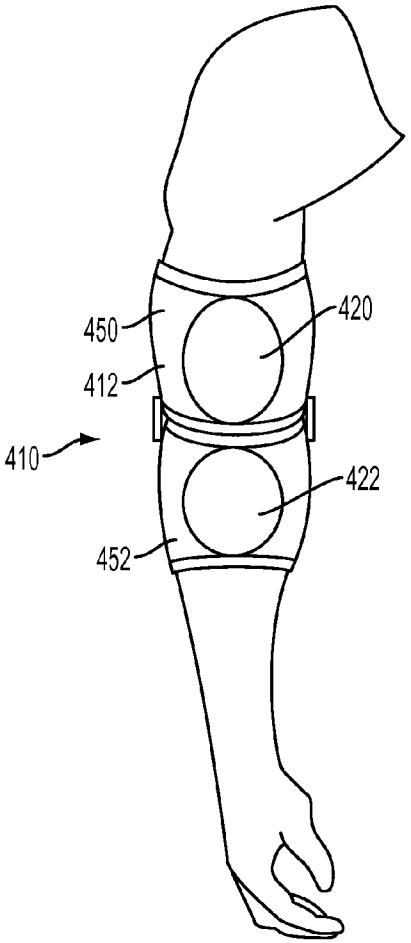
FIG. 6B depicts a top view of the pad system shown in FIG. 6A.
Figure 6A:
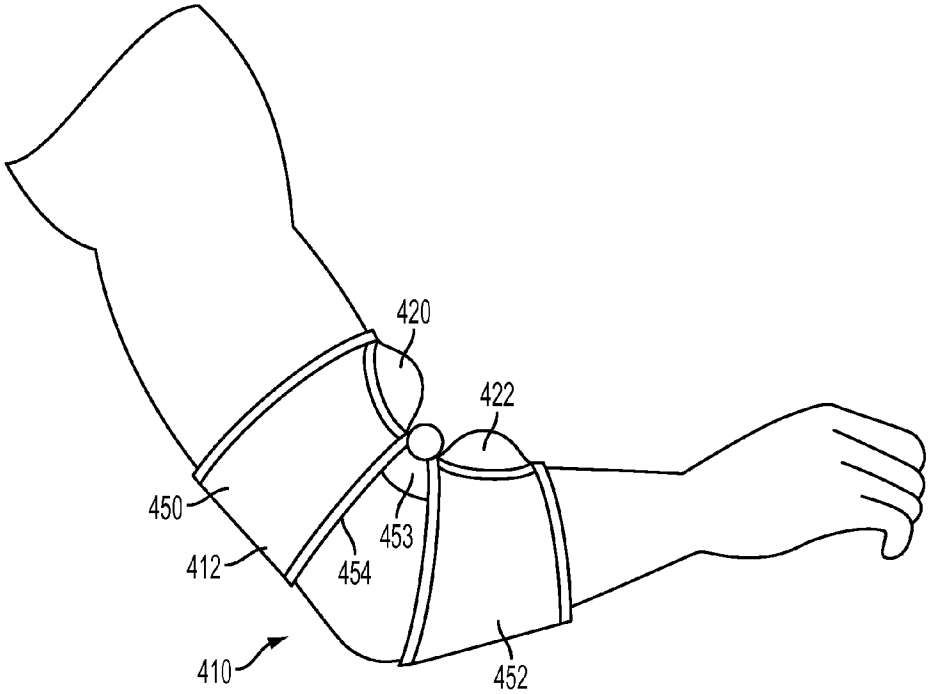
FIG. 6A depicts a right side view of a pad system according to an alternate embodiment.

Referring now to FIG. 6, an alternate version of a pad system 410 is shown. The pad system 410 can include a sleeve 412 having an upper arm portion 450 and a lower arm portion 452, where the upper arm portion 450 can be coupled with the lower arm portion 452 at a joint 453. The sleeve 412 can be constructed from neoprene or an elastic material and can be sized to fit a user's arm. The sleeve 412 can be pulled onto a user's arm until comfortably and suitably positioned such that the upper portion 450 is positioned substantially above the elbow or other joint, and the lower portion 452 is positioned substantially below the elbow or joint. In the illustrated embodiment, the sleeve can define a cutout 454 at about the position of a user's elbow. It will be appreciated that the pad system 410 can be associated or configured for use with any body part such as, for example a knee, ankle, or neck. The sleeve 412 can include a first pad 420 and a second pad 422 where, when the sleeve 412 is worn correctly, the first pad 420 and the second pad 422 can be situated on the inside of the elbow or any other suitable joint to prevent hyper-flexion. The first pad 120 and the second pad 122 can be fixed, as shown, or can be removable such that any suitable pad can be associated with the sleeve 412.

Figure 7:
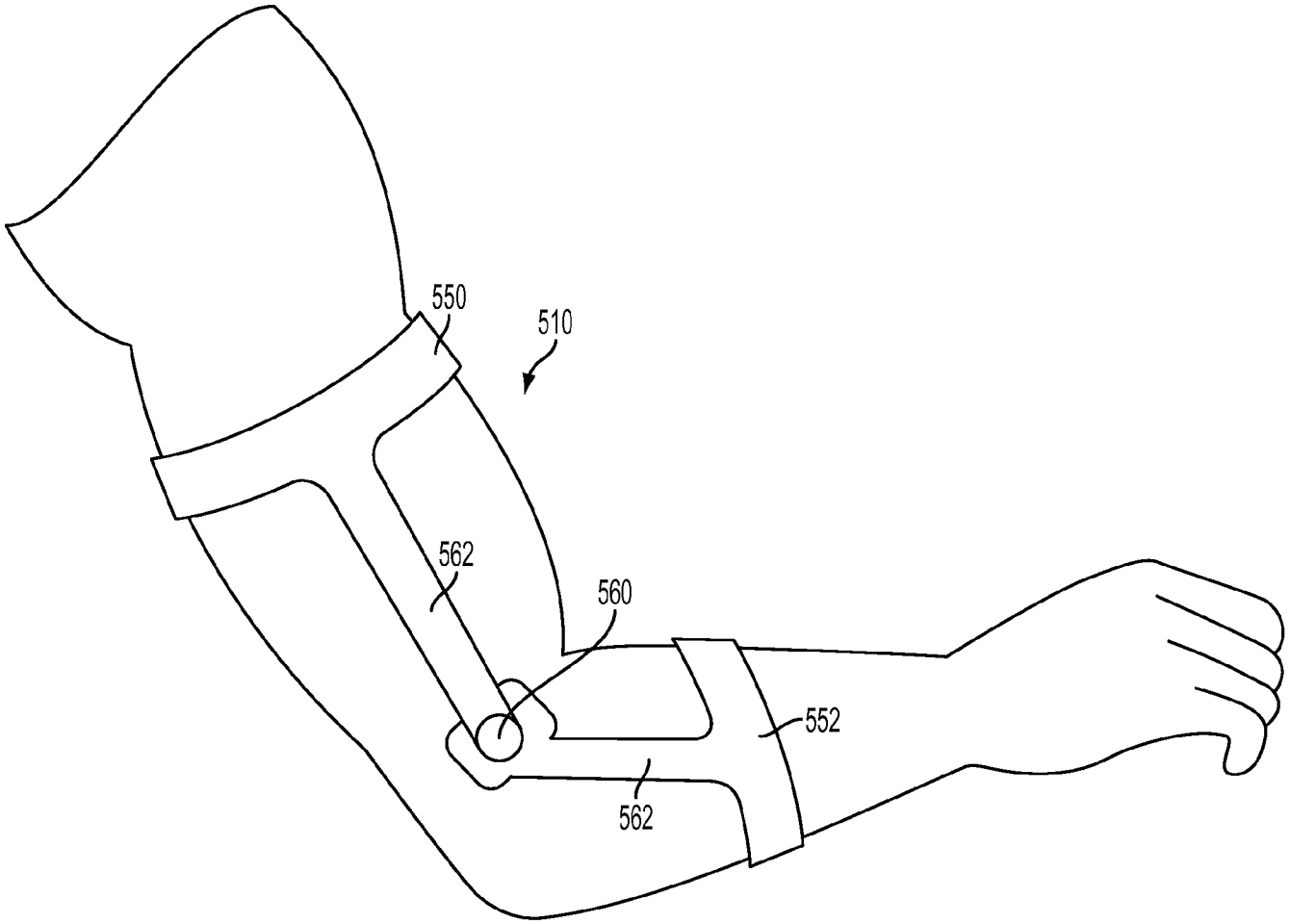
FIG. 7 depicts a right side view of a hinged system that can minimize the risk of hyper-flexion according to one embodiment.

Referring now to FIG. 7, one version of a hinged system 510 is shown. The hinged system 510 can include an upper arm portion 550 and a lower arm portion 552 that can be coupled with hinge 560 at about the joint of a user. The hinge 560 can be coupled with the upper arm portion 550 and lower arm portion 552 with rigid struts 562. The hinged system 510 can be pulled onto a user's arm until comfortably and suitably positioned such that the upper portion 550 is positioned substantially above the elbow or other joint, and the lower portion 552 is positioned substantially below the elbow or joint. The hinge 560 can be configured with a stop (not shown) or other suitable design that can mechanically prevent the flexion of the upper arm portion 550 relative to the lower arm portion 552 beyond a desired angle. Such a configuration can prevent the hyper-flexion of a joint without the use of a pad. It will be appreciated that any suitable mechanism for preventing hyper-flexion can be incorporated into systems disclosed herein.

Figure 8:
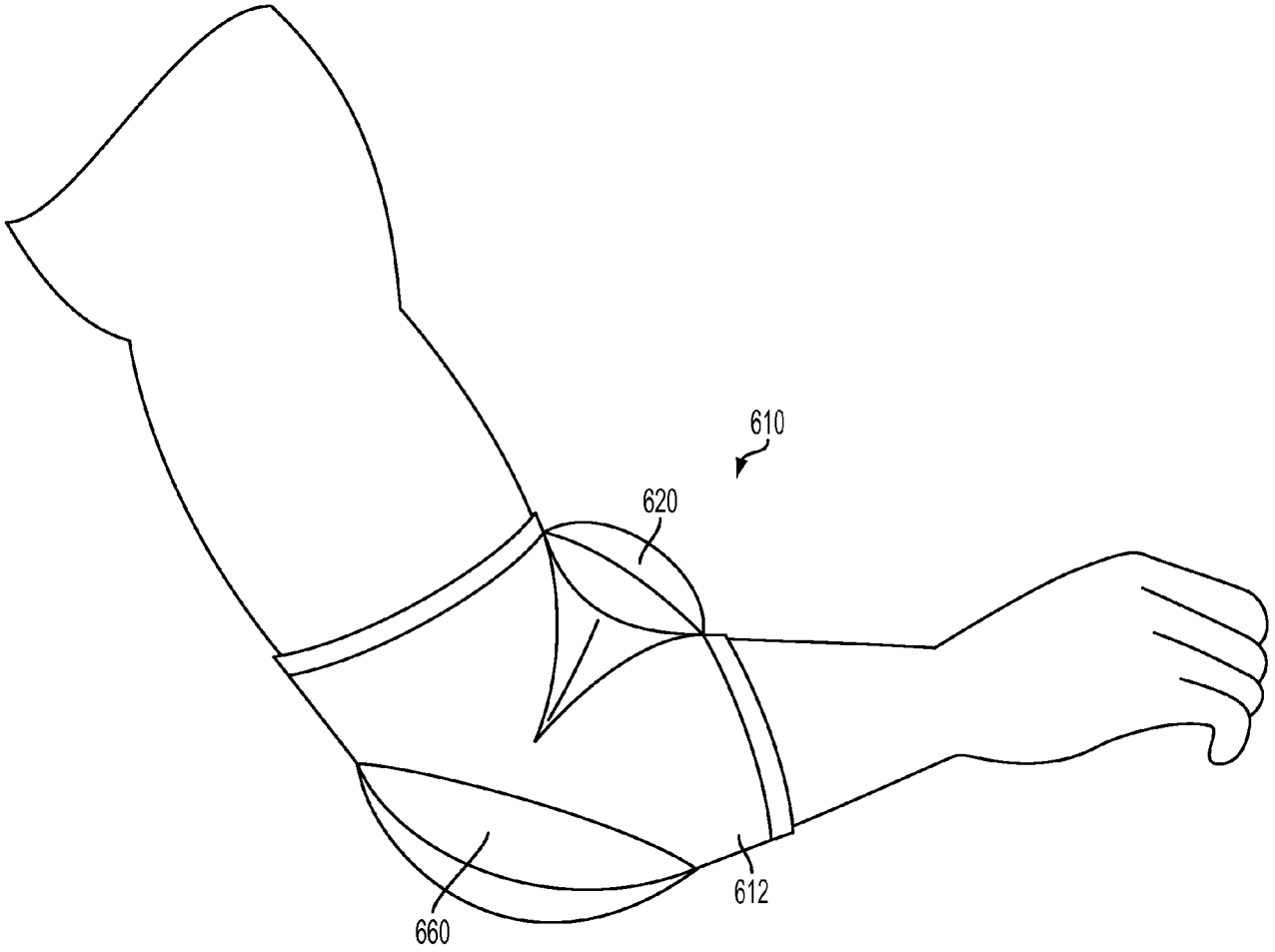
FIG. 8 depicts a right side view of a pad system according to an alternate embodiment.

Referring now to FIG. 8, an alternate version of a pad system 610 is shown. The pad system 610 can include a sleeve 612. The sleeve 612 can be pulled onto a user's arm until comfortably and suitably positioned. It will be appreciated that the pad system 610 can be associated or configured for use with any body part such as, for example a knee, ankle, or neck. The sleeve 612 can include a removable pad 620 where, when the sleeve 612 is worn correctly, the pad 620 can be situated on the inside of the elbow or any other suitable joint to prevent hyper-flexion. The sleeve 612 can include a removable elbow pad 660, where it will be appreciated that any suitable number of pads in any suitable location are contemplated.

In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

We claim:

1. An apparatus for preventing hyper-flexion of a joint comprising:

(a) a sleeve having a first end and a second end and an upper portion and a lower portion;

(b) a first pad associated with the upper portion of the sleeve, wherein the first pad is retained within a first covering and is selectively removable from the first covering;

(c) a second pad associated with the lower portion of the sleeve, the second pad being retained within a second covering and being selectively removable from the second covering, wherein the first pad is spaced apart from the second pad by a distance;

(d) an angle of engagement, wherein the angle of engagement is a predetermined angle at which the first pad engages the second pad to resist further motion and to prevent hyper-flexion of the joint;

wherein the first pad retained within the first covering is selectively replaceable with a first alternate pad and the second pad retained within the second covering is selectively replaceable with a second alternate pad.

2. The apparatus of claim 1, wherein the sleeve is constructed at least partially from a flexible material such that the sleeve is pulled on by a user.

3. The apparatus of claim 1, wherein the upper portion is constructed at least partially from a pliable material and the lower portion is constructed at least partially from a rubberized backing.

4. The apparatus of claim 1, wherein the first pad and the second pad are differently sized from the first alternate pad and the second alternate pad.

5. The apparatus of claim 4, wherein the first pad and the second pad are selected from the group consisting of a spherical pad, a cone-shaped pad, and a box-shaped pad.

6. The apparatus of claim 5, wherein the first alternate pad and the second alternate pad are selected from the group consisting of a spherical pad, a cone-shaped pad, and a box-shaped pad.

7. The apparatus of claim 4, wherein the first pad and the first alternate pad are identically shaped, but differently sized.

8. The apparatus of claim 7, wherein the second pad and the second alternate pad are identically shaped, but differently sized.

9. The apparatus of claim 1, wherein the distance between the first pad and the second pad is from about 0.25 inches to about 1 inch.

10. The apparatus of claim 9, wherein the distance between the first pad and second pad is from about 0.5 inches to about 0.75 inches.

11. The apparatus of claim 1, wherein the angle of engagement between the first pad and the second pad is from about 45 degrees to about 125 degrees.

12. The apparatus of claim 11, wherein the angle of engagement is from about 75 degrees to about 90 degrees.

13. The apparatus of claim 1, wherein the sleeve is operably configured to be worn at about a user's knee.

14. An apparatus for preventing hyper-flexion of a joint comprising:

(a) a sleeve having a first end and a second end and an upper portion and a lower portion;

(b) a first pad associated with the upper portion of the sleeve, wherein the first pad is retained within a first covering and is selectively removable from the first covering;

(c) a second pad associated with the lower portion of the sleeve, the second pad being retained within a second covering and being selectively removable from the second covering, wherein the first pad is spaced apart from the second pad by a distance;

(d) a first alternate pad, the first alternate pad being selectively insertable into the first covering, wherein the first pad and the first alternate pad are differently sized; and (e) a second alternate pad, the second alternate pad being selectively insertable into the second covering, wherein the second pad and the second alternate pad are differently sized;

(d) an angle of engagement, wherein the angle of engagement is a predetermined angle at which the first pad engages the second pad to resist further motion and for preventing hyper-flexion of the joint.

15. The apparatus of claim 14, wherein the first pad and the second pad are differently sized.

16. The apparatus of claim 14, wherein the first pad and the first alternate pad are identically shaped.

17. The apparatus of claim 16, wherein the second pad and the second alternate pad are identically shaped.

18. The apparatus of claim 14, wherein the distance is operably sized to prevent hyper-flexion of the joint.

19. An apparatus for preventing hyper-flexion of a joint comprising:

(a) a sleeve having a first end and a second end and an upper portion, constructed at least partially from a flexible material, and a lower portion, constructed at least partially from rubberized backing, wherein the sleeve includes a first annular elastic strip at about the first end and a second annular elastic strip at about the second end;

(b) a first pad retained within a first covering, the first pad being associated with the upper portion of the sleeve, wherein the first pad is selectively removable from the first covering;

(c) a second pad retained within a second covering, the second pad being associated with the lower portion of the sleeve, wherein the second pad is selectively removable from the second covering and wherein the first pad is spaced apart from the second pad by a distance of from about 0.25 inches to about 1 inch;

(d) an angle of engagement from about 45 degrees to about 125 degrees, wherein the angle of engagement is a predetermined angle at which the first pad engages the second pad to resist further motion and for operably preventing hyper-flexion of the joint;

(e) a first alternate pad, the first alternate pad being selectively insertable into the first covering, wherein the first pad and the first alternate pad are differently sized and differently shaped; and (f) a second alternate pad, the second alternate pad being selectively insertable into the second covering, wherein the second pad and the second alternate pad are differently sized and differently shaped.

* * * * *